US009733009B2

(12) United States Patent
Lee et al.

(10) Patent No.: US 9,733,009 B2
(45) Date of Patent: Aug. 15, 2017

(54) REFRIGERATOR

(71) Applicant: LG Electronics Inc., Seoul (KR)

(72) Inventors: Sangbong Lee, Seoul (KR); Jangseok Lee, Seoul (KR); Hyoungkeun Lim, Seoul (KR); Myungjin Chung, Seoul (KR); Minkyu Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 251 days.

(21) Appl. No.: 14/531,286

(22) Filed: Nov. 3, 2014

(65) Prior Publication Data

US 2015/0121926 A1 May 7, 2015

(30) Foreign Application Priority Data

Nov. 4, 2013 (KR) ..... 10-2013-0133028

(51) Int. Cl.
*F25D 11/02* (2006.01)
*F25B 5/02* (2006.01)
(Continued)

(52) U.S. Cl.
CPC ..... *F25D 11/022* (2013.01); *F25B 1/005* (2013.01); *F25B 5/02* (2013.01); *F25B 43/00* (2013.01);
(Continued)

(58) Field of Classification Search
CPC .... F25D 11/02; F25D 11/022; F25B 2400/23; F25B 1/005; F25B 1/10; F25B 5/02;
(Continued)

(56) References Cited

U.S. PATENT DOCUMENTS 7,293,428 B2 * 11/2007 Itsuki ..... F25B 1/10 62/222
7,331,196 B2 * 2/2008 Itsuki ..... F25B 5/02 62/510
(Continued)

FOREIGN PATENT DOCUMENTS

CN 1670448 9/2005
CN 1886626 12/2006
(Continued)

OTHER PUBLICATIONS

Chinese Office Action dated Jul. 15, 2016 (Translation).
(Continued)

*Primary Examiner* — Marc Norman
(74) *Attorney, Agent, or Firm* — Ked & Associates LLP

(57) ABSTRACT

A refrigerant is provided that may include at least one compressor that compresses a refrigerant, a condenser that condenses the refrigerant compressed in the at least one compressor, a first expansion device that decompresses the refrigerant condensed in the condenser, a gas/liquid separator that separates the refrigerant decompressed in the first expansion device into a liquid refrigerant and a gaseous refrigerant, first and second evaporators, to which the liquid refrigerant separated in the gas/liquid separator may be introduced, and a second expansion device disposed at an inlet-side of the second evaporator to decompress the refrigerant.

22 Claims, 8 Drawing Sheets

(51) Int. Cl.

| | |
|---|---|
| ***F25B 43/00*** | (2006.01) |
| ***F25D 29/00*** | (2006.01) |
| ***F25B 1/00*** | (2006.01) |
| ***F25B 49/02*** | (2006.01) |
| *F25B 1/10* | (2006.01) |

(52) U.S. Cl.
CPC ..... *F25B 49/02* (2013.01); *F25D 29/00* (2013.01); *F25B 1/10* (2013.01); *F25B 2341/0662* (2013.01); *F25B 2400/13* (2013.01); *F25B 2400/23* (2013.01); *F25B 2600/2507* (2013.01)

(58) Field of Classification Search
CPC .. F25B 43/00; F25B 49/02; F25B 2341/0662; F25B 2400/13; F25B 2600/2507
USPC ..... 62/196.2, 200, 504, 512
See application file for complete search history.

(56) References Cited

U.S. PATENT DOCUMENTS

2005/0198996 A1 9/2005 Itsuki et al.
2006/0218952 A1* 10/2006 Nagae ..... F25B 1/10 62/216
2006/0230782 A1* 10/2006 Imai ..... F04C 18/3564 62/512

FOREIGN PATENT DOCUMENTS

| | | |
|---|---|---|
| EP | 1 707 900 | 10/2006 |
| JP | 57-33768 | 2/1982 |
| JP | 11-118297 | 4/1999 |
| JP | 2000-258020 | 9/2000 |
| JP | 2002-181398 | 6/2002 |
| JP | 2005-214505 | 8/2005 |
| JP | 2008-286474 | 11/2008 |
| JP | 2012-068102 | 4/2012 |

OTHER PUBLICATIONS

European Search Report issued in Application No. 14191506.6 dated Jun. 12, 2015.
European Search Report dated Oct. 2, 2015.

* cited by examiner

REFRIGERATOR

CROSS-REFERENCE TO RELATED APPLICATION(S)

The present application claims priority under 35 U.S.C. 119 and 35 U.S.C. 365 to Korean Patent Application No. 10-2013-0133028, filed in Korea on Nov. 4, 2013, and No. 10-2014-0010867, filed in Korea on Jan. 28, 2014, which are hereby incorporated by reference in their entirety.

BACKGROUND

1. Field

A refrigerator is disclosed herein.

2. Background

In general, a refrigerator has a plurality of storage compartments to accommodate food to be stored so as to store the food in a frozen or refrigerated state. The storage compartment may have one surface that is open to receive or dispense the food. The plurality of storage compartments may include a freezer compartment to store food in the frozen state, and a refrigerator compartment to store food in the refrigerated state.

A refrigeration system, in which a refrigerant is circulated, is driven in the refrigerator. The refrigeration system may include a compressor, a condenser, an expansion device, and an evaporator. The evaporator may include a first evaporator disposed at a side of the refrigerator compartment and a second evaporator disposed at a side of the freezer compartment.

Cool air stored in the refrigerator compartment may be cooled while passing through the first evaporator, and the cooled cool air may be supplied again into the refrigerator compartment. Also, the cool air stored in the freezer compartment may be cooled while passing through the second evaporator, and the cooled cool air may be supplied again into the freezer compartment.

As described above, in the refrigerator according to the related art, independent cooling may be performed in the plurality of storage compartments through separate evaporators. According to the refrigerator according to the related art, a refrigerant introduced into the first and second evaporators may be decompressed by the expansion device to change into a two-phase refrigerant, for example, a two-phase refrigerant having a relatively high dryness fraction, thereby deteriorating heat-exchange efficiency in the first and second evaporators.

Also, the refrigerant may be selectively supplied into the first evaporator or the second evaporator according to a cooling operation mode, that is, whether a refrigerator compartment cooling operation or a freezer compartment cooling operation is performed. However, a phenomenon in which an amount of refrigerant circulated in the refrigeration cycle is lacking according to operation mode conditions may occur.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. Embodiments may, however, be embodied in many different forms and should not be construed as being limited to the embodiments set forth herein; rather, alternate embodiments included in other retrogressive embodiments or falling within the spirit and scope will fully convey the concept to those skilled in the art.

Figure 1:
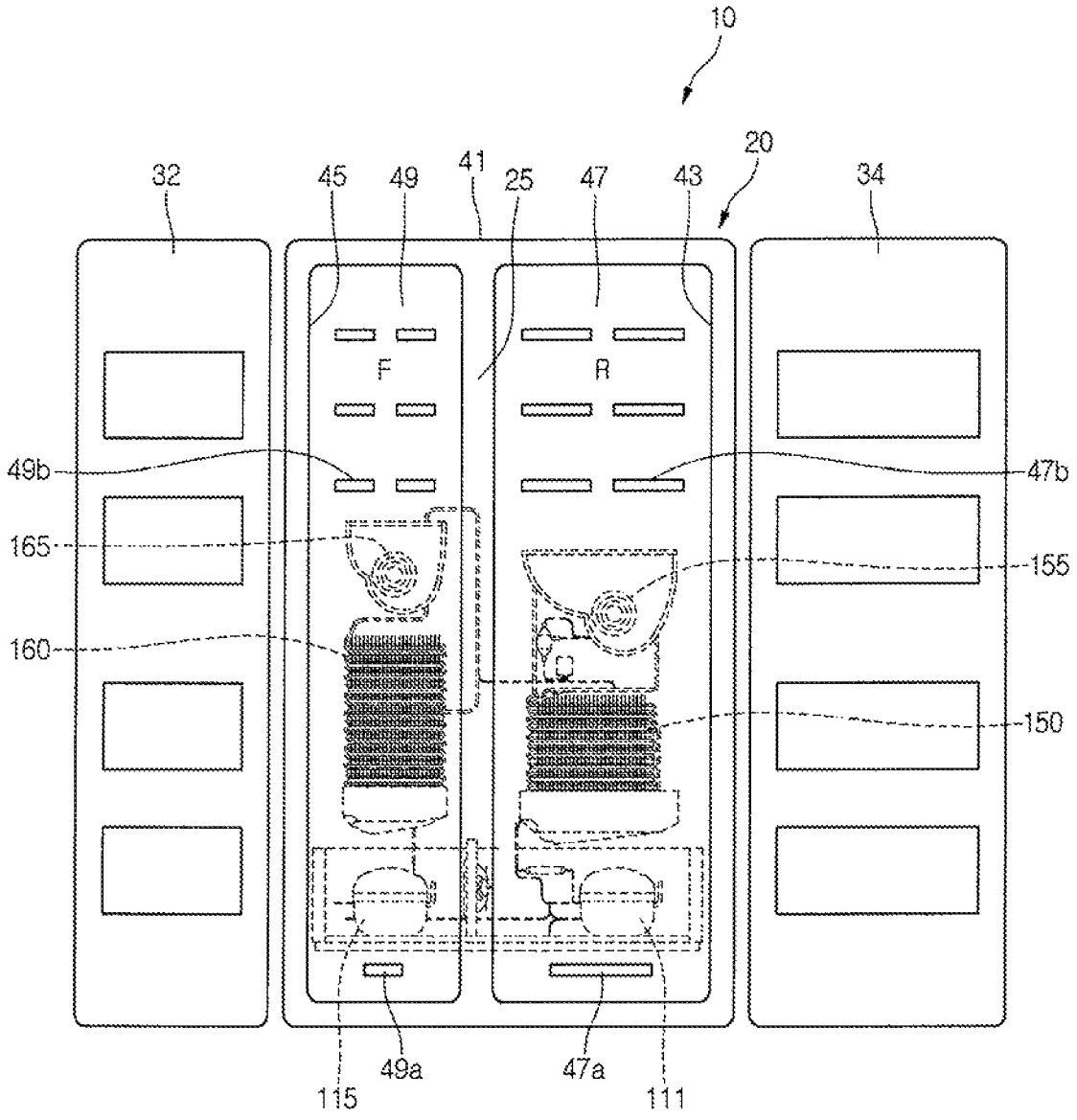
FIG. 1 is a schematic diagram of a refrigerator according to an embodiment.

FIG. 1 is a schematic diagram of a refrigerator according to an embodiment. Referring to FIG. 1, a refrigerator 10 according to an embodiment may include a main body 20 having a freezer compartment F and a refrigerator compartment R. The freezer compartment F and the refrigerator compartment R may be independently provided in the main body 2 and partitioned by a partition wall 25.

Although the freezer compartment F and the refrigerator compartment R are shown horizontally spaced apart from each other in FIG. 1, embodiments are not limited thereto. For example, the freezer compartment F and the refrigerator compartment R may be vertically spaced apart from each other.

The main body 20 may include a freezer compartment door 32 to open and close the freezer compartment F and a refrigerator compartment door 34 to open and close the refrigerating compartment R. The main body 20 may include an outer case 41 that defines an exterior of the refrigerator 10, a freezer compartment inner case 45 disposed inside the outer case 41 to define an inner surface of the freezer compartment F, and a refrigerator compartment inner case 43 disposed inside the outer case 41 to define an inner surface of the refrigerator compartment R.

The refrigerator 10 may further include a plurality of evaporators 150 and 160 to independently cool the refrigerator compartment R and the freezer compartment F. The plurality of evaporators 150 and 160 may include a first evaporator 150 to cool one storage compartment of the refrigerator compartment R or the freezer compartment F, and a second evaporator 160 to cool the other storage compartment.

For example, the first evaporator 150 may function as a refrigerator compartment evaporator to cool the refrigerator compartment R, and the second evaporator 160 may function as a freezer compartment evaporator to cool the freezer compartment F. Hereinafter, an embodiment will be described with reference to the above-described example.

The main body 20 may include a freezer compartment rear panel 49 that partitions an inner space of the freezer compartment inner case 45 into the freezer compartment F that stores food in a frozen state, and a freezer heat-exchange chamber (see reference numeral 161 of FIG. 3) in which the freezer compartment evaporator 160 may be accommodated. That is, the freezer compartment rear panel 49 may be understood as a "freezer compartment cover" that functions as a storage compartment cover to shield the freezer heat-exchange chamber 161 from the freezer compartment F.

A cool air suction hole 49*a*, through which the cool air of the freezer compartment F may be introduced into the freezer heat-exchange chamber 161, and a cool air discharge hole 49*b*, through which the cool air cooled by the freezer compartment evaporator 160 may be discharged into the freezer compartment F, may be defined in the freezer compartment rear panel 49. A freezer compartment fan 165 that functions as a "blower fan" to circulate air of the freezer compartment F into the freezer heat-exchange chamber 161, and the freezer compartment F may be disposed in the freezer heat-exchange chamber 161.

The main body 20 may further include a refrigerator compartment rear panel 47 that partitions an inner space of the refrigerator compartment inner case 43 into the refrigerator compartment R to store food in a refrigerated state, and a refrigerator heat-exchange chamber (see reference numeral 151 of FIG. 3) in which the refrigerator compartment evaporator 150 may be accommodated. The refrigerator heat-exchange chamber 151 and the freezer heat-exchange chamber 161 may each be referred to as a "heat-exchange chamber". Further, the refrigerator compartment rear panel 47 may be understood as a "refrigerator compartment cover" that functions as a storage compartment cover to shield the refrigerator heat-exchange chamber 151 from the refrigerator compartment R. The refrigerator compartment cover and the freezer compartment cover may be disposed on first and second sides of the partition wall 25.

A cool air suction hole 47*a*, through which the cool air of the refrigerator compartment R may be introduced into the refrigerator heat-exchange chamber 151, and a cool air discharge hole 47*b*, through which the cool air cooled by the refrigerator compartment evaporator 150 may be discharged into the refrigerator compartment R, may be defined in the refrigerator compartment rear panel 47. Also, a refrigerator compartment fan 155 that functions as a "blower fan" to circulate air of the refrigerator compartment R into the refrigerator heat-exchange chamber 151 and the refrigerator compartment R may be disposed in the refrigerator heat-exchange chamber 151.

Figure 2:
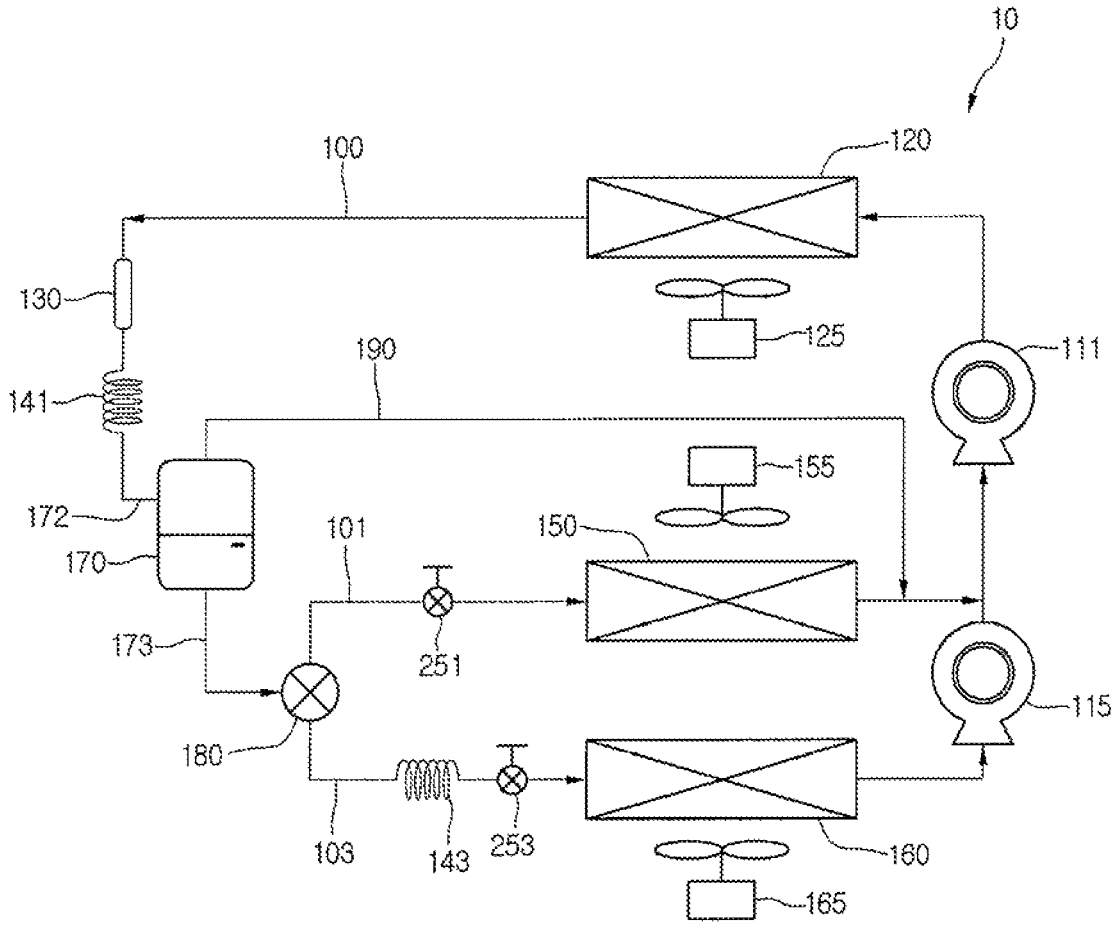
FIG. 2 is a schematic diagram of a refrigeration cycle in a refrigerator according to an embodiment.

FIG. 2 is a schematic diagram of a refrigeration cycle in a refrigerator according to an embodiment. Referring to FIG. 2, the refrigerator 10 according to an embodiment may include a plurality of devices to drive a refrigeration cycle.

In detail, the refrigerator 10 may include a plurality of compressors 111 and 115 that compress a refrigerant, a condenser 120 that condenses the refrigerant compressed in the plurality of compressors 111 and 115, a plurality of expansion devices 141 and 143 that decompress the refrigerant condensed in the condenser 120, and a plurality of evaporators 150 and 160 that evaporate the refrigerant decompressed in the plurality of expansion devices 141 and 143. The refrigerator 10 may include a refrigerant tube 100 that connects the plurality of compressors 111 and 115, the condenser 120, the plurality of expansion devices 141 and 143, and the plurality of evaporators 150 and 160 to each other to guide a flow of the refrigerant.

The plurality of compressors 111 and 115 may include a first compressor 111 and a second compressor 115. For example, when all of the plurality of compressors 111 and 115 are driven, the second compressor 115 may function as a "low-pressure compressor" disposed at a low-pressure side to compress the refrigerant in a first stage, and the first compressor 111 may function as a "high-pressure compressor" to further compress (a two-stage compression) the refrigerant compressed in the second compressor 115. When all of the plurality of compressors 111 and 115 are driven, a simultaneous cooling operation of the refrigerator compartment R and the freezer compartment F may be performed. On the other hand, if only the first compressor 111 of the plurality of compressors 111 and 115 is driven, an exclusive cooling operation may be performed for the storage compartment in which the first evaporator 150 is disposed, that is, the refrigerator compartment R.

The plurality of evaporators 150 and 160 may include the first evaporator 150 to generate cool air to be supplied into one of the refrigerator compartment R, and the second evaporator 160 to generate cool air to be supplied into the freezer compartment F. Thus, as set forth above, the first evaporator 150 may be the refrigerator compartment evaporator, generate cool air to be supplied into the refrigerator compartment R, and be disposed on or at a side of the refrigerator compartment R. The second evaporator 160 may be the freezer compartment evaporator, generate cool air to be supplied into the freezer compartment F, and be disposed on or at a side of the freezer compartment F.

The cool air supplied into the freezer compartment F may have a temperature less than a temperature of the cool air supplied into the refrigerator compartment R. Thus, the refrigerant within the second evaporator 160 may have an evaporation pressure less than an evaporation pressure of the refrigerant within the first evaporator 150.

An outlet-side refrigerant tube 100 of the second evaporator 160 may extend to an inlet-side of the second compressor 115. Thus, the refrigerant passing through the second evaporator 160 may be introduced into the second compressor 115.

The refrigerator 10 may further include a dryer 130 disposed at an outlet-side of the condenser 120 to remove moisture or foreign substances contained in the refrigerant condensed in the condenser 120, and a gas/liquid separator 170 disposed at an outlet-side of the dryer 130 to separate a liquid refrigerant and a gaseous refrigerant of the refrigerant from each other.

The plurality of expansion devices 141 and 143 may include a first expansion device 141 disposed at the outlet-side of the dryer 130 to decompress the refrigerant. The first expansion device 141 may include a capillary tube. An inflow tube 172 that extends to the gas/liquid separator 170 to guide the refrigerant to the gas/liquid separator 170 may be disposed at an outlet-side of the first expansion device 141.

The liquid refrigerant of the refrigerant introduced into the gas/liquid separator 170 through the inflow tube 172 may be collected in or at a lower portion of the gas/liquid separator 170, and the gaseous refrigerant may fill into an upper portion of the gas/liquid separator 170. A liquid refrigerant discharge 173 to discharge the liquid refrigerant separated in the gas/liquid separator 170 may be disposed on or at a first side of the gas/liquid separator 170. The liquid discharge 173 may be connected to a lower portion of the gas/liquid separator 170.

A gaseous refrigerant discharge 190 to discharge the gaseous refrigerant separated in the gas/liquid separator 170 may be disposed on a second, opposite side of the gas/liquid separator 170. The gaseous refrigerant discharge 190 may be connected to an upper portion of the gas/liquid separator 170.

The liquid refrigerant discharge 173 may be connected to a flow adjuster 180. The flow adjuster 180 may allow flow to one evaporator of the first and second evaporators 150 and 160, so that at least one evaporator of the first and second evaporators 150 and 160 is driven, or may adjust a flow of the refrigerant so that the refrigerant is divided and flows into the first and second evaporators 150 and 160. The flow adjuster 180 may include a three-way valve having one inflow, through which the refrigerant may be introduced, and two discharges, through which the refrigerant may be discharged.

A plurality of refrigerant passages 101 and 103 may be connected to the two discharges of the flow adjuster 180. The plurality of refrigerant passages 101 and 103 may include a first refrigerant passage 101 disposed on or at an inlet-side of the first evaporator 150 to guide introduction of the refrigerant into the first evaporator 150, and a second refrigerant passage 103 disposed on or at an inlet-side of the second evaporator 160 to guide introduction of the refrigerant into the second evaporator 160.

The first and second refrigerant passages 101 and 103 may be branched passages of the refrigerant tube 100, and thus, may be referred to as "first and second evaporation passages", respectively. Also, the flow adjuster 180 may be understood to be disposed on or at a branch point, which is branched into the first and second refrigerant passages 101 and 103.

Thus, the refrigerant passing through the flow adjuster 180 may be branched and discharged into the first and second refrigerant passages 101 and 103. The discharges of the flow adjuster 180 connected to the first and second refrigerant passages 101 and 102 may be referred to as a "first discharge" and a "second discharge", respectively.

At least one of the first and second discharges may be open. For example, when both of the first and second discharges are open, the refrigerant may flow through the first and second refrigerant passages 101 and 103. On the other hand, when the first discharge is open, and the second discharge is closed, the refrigerant may flow through the first refrigerant passage 101. Of course, when the first discharge is closed, and the second discharge is open, the refrigerant may flow through only the second refrigerant passage 103.

The second expansion device 143 to expand the refrigerant to be introduced into the second evaporator 160 may be disposed in the second refrigerant passage 103. The second expansion device 143 may include a capillary tube.

The refrigerant flowing into the second refrigerant passage 103 may be decompressed while passing through the second expansion device 143. Thus, the refrigerant introduced into the second evaporator 160 may have an evaporation pressure less than an evaporation pressure of the refrigerant introduced into the first evaporator 150. Also, the cool air passing through the second evaporator 160 may be cooled to a temperature less than a temperature of the cool air passing through the first evaporator 150, and then, may be supplied into the freezer compartment F.

The refrigerator 10 may include blower fans 125, 155, and 165 disposed on or at one side of each heat exchanger to blow air. The blower fans 125, 155, and 165 may include a condensation fan 125 provided on or at one side of the condenser 120, the first evaporation fan 155 provided on or at one side of the first evaporator 150, and the second evaporation fan 165 provided on or at one side of the second evaporator 160. As set forth above, the first evaporation fan 155 may be the refrigerator compartment fan, and the second evaporation fan 165 may be the freezer compartment fan.

Heat-exchange performance of each of the first and second evaporators 150 and 160 may vary according to a rotation rate of the first and second evaporation fans 155 and 165. For example, if a large amount of refrigerant is required according to operation of the first or second evaporator 150 or 160, the first or second evaporation fan 155 or 166 may increase in rotation rate. Also, if the cool air is sufficient, the first or second evaporation fan 155 or 165 may be reduced in rotation rate.

The refrigerator 10 may further include flow rate adjusters 251 and 253 to adjust a flow of the refrigerant. The flow rate adjusters 251 and 253 may be disposed in at least one refrigerant passage of the first and second refrigerant passages 101 and 103. For example, the flow rate adjusters 251 and 253 may include a first flow rate adjuster 251 disposed in the first refrigerant passage 101, and a second flow rate adjuster 253 disposed in the second refrigerant passage 103.

Each of the first and second flow rate adjusters 251 and 253 may include an electric expansion valve (EEV), an opening degree of which may be adjustable. If the opening degree of the first or second flow rate adjuster 251 or 253 decreases, an amount of refrigerant flowing through an opening having the decreased opening degree may decrease. On the other hand, if the opening degree of the first or second flow rate adjuster 251 or 253 increases, an amount of refrigerant flowing through an opening having the increased opening degree may increase.

For example, if the opening degree of the first flow rate adjuster 251 is relatively greater than the opening degree of the second flow rate adjuster 253, a larger amount of refrigerant may flow into the first refrigerant passage 101, and thus, an amount of refrigerant introduced into the first evaporator 150 may increase. On the other hand, if the opening degree of the first flow rate adjuster 251 is relatively less than the opening degree of the second flow rate adjuster 253, a larger amount of refrigerant may flow into the second refrigerant passage 103, and thus, an amount of refrigerant introduced into the second evaporator 160 may increase.

As the first and second flow rate adjusters 251 and 253 are provided, the opening degree of each of the refrigerant passages may be finely adjustable. Thus, an amount of refrigerant to be introduced into the first or second evaporator 150 or 160 may be finely adjustable. As a result, while the first and second evaporators 150 and 160 operate, the refrigerant concentration into the first or second evaporator 150 or 160 may be prevented.

Another embodiment will now be described. Although the first and second flow rate adjusters 251 and 253 are shown in FIG. 2, respectively, disposed in the first and second refrigerant passages 201 and 203, embodiments are not limited thereto. For example, one flow rate adjuster may be disposed in the first or second refrigerant passage 101 or 103. As the flow rate adjuster is provided in one refrigerant passage to adjust the opening degree, an amount of refrigerant passing through the other refrigerant passage may be relatively adjustable. That is, if the opening degree of the flow rate adjuster increases, an amount of refrigerant passing through the other refrigerant passage may decrease. On the other hand, if the opening degree of the flow rate adjuster decreases, an amount of refrigerant passing through the other refrigerant passage may increase.

As the liquid refrigerant discharge 173 is connected to the flow adjuster 180, the liquid refrigerant separated in the gas/liquid separator 170 may be supplied into the first or second refrigerant passage 101 or 103 via the flow adjuster 180. Thus, the refrigerant introduced into the first or second evaporator 150 or 160 may be liquid refrigerant. Thus, the first and second evaporators 150 and 160 may be improved in heat exchange efficiency, that is, evaporation efficiency.

The gaseous refrigerant discharge 190 may extend to an outlet-side of the first evaporator 150. That is, the gaseous refrigerant discharge may have a first side connected to an upper portion of the gas/liquid separator 170, and a second side connected to an outlet-side of the first evaporator 150. The gaseous refrigerant discharge 190 may be referred to as a "bypass passage" in that the refrigerant may bypass the first or second evaporator 150 or 160 through the gaseous refrigerant discharge 190. Thus, the gaseous refrigerant separated in the gas/liquid separator 170 may be introduced into the outlet-side of the first evaporator 150, and then, may be suctioned into the first compressor 111 to prevent a deficit of refrigerant circulating in the refrigeration cycle from occurring.

Figure 3:
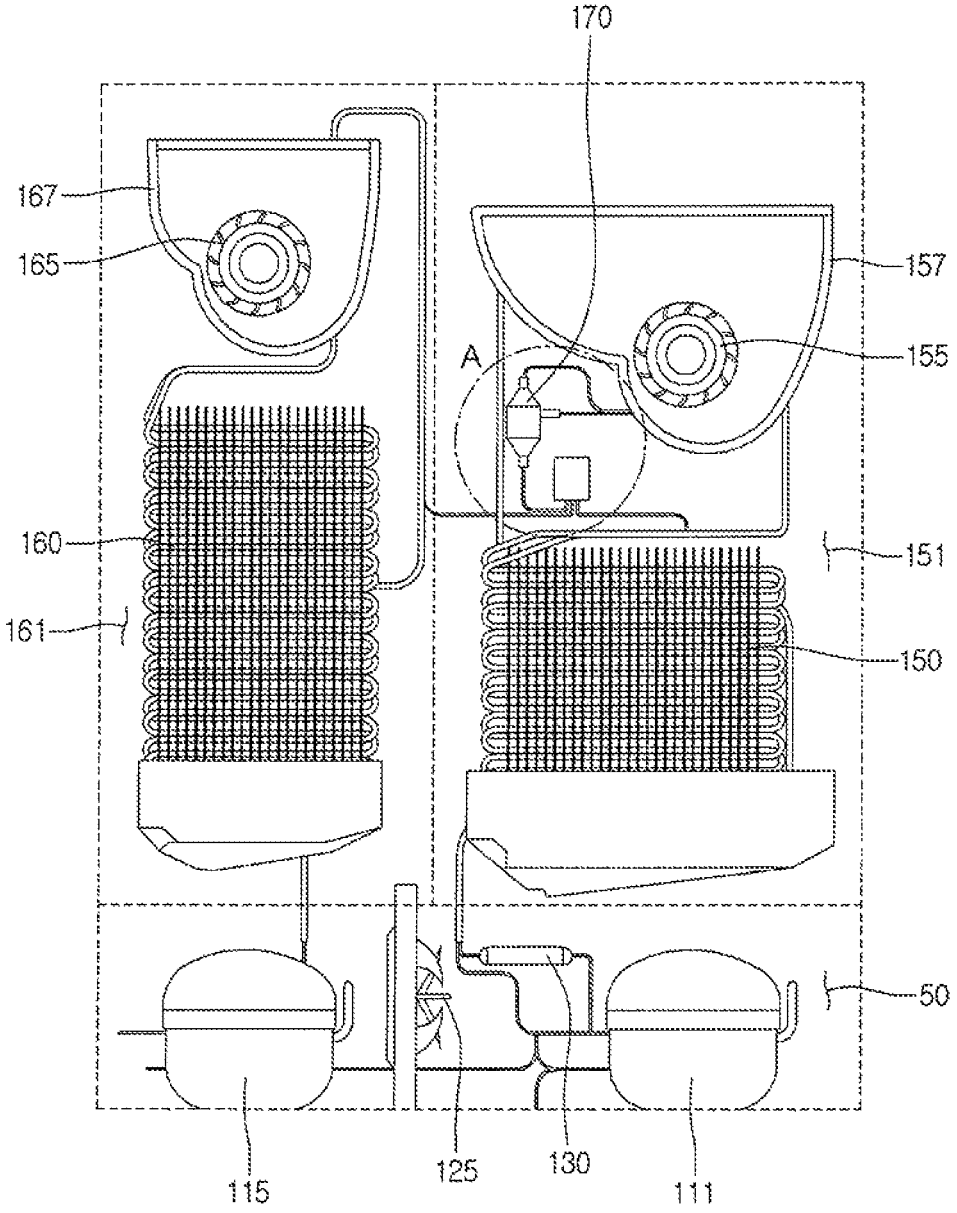
FIG. 3 is a view illustrating a portion of a refrigerator according to an embodiment, when viewed from a front side.
Figure 4:
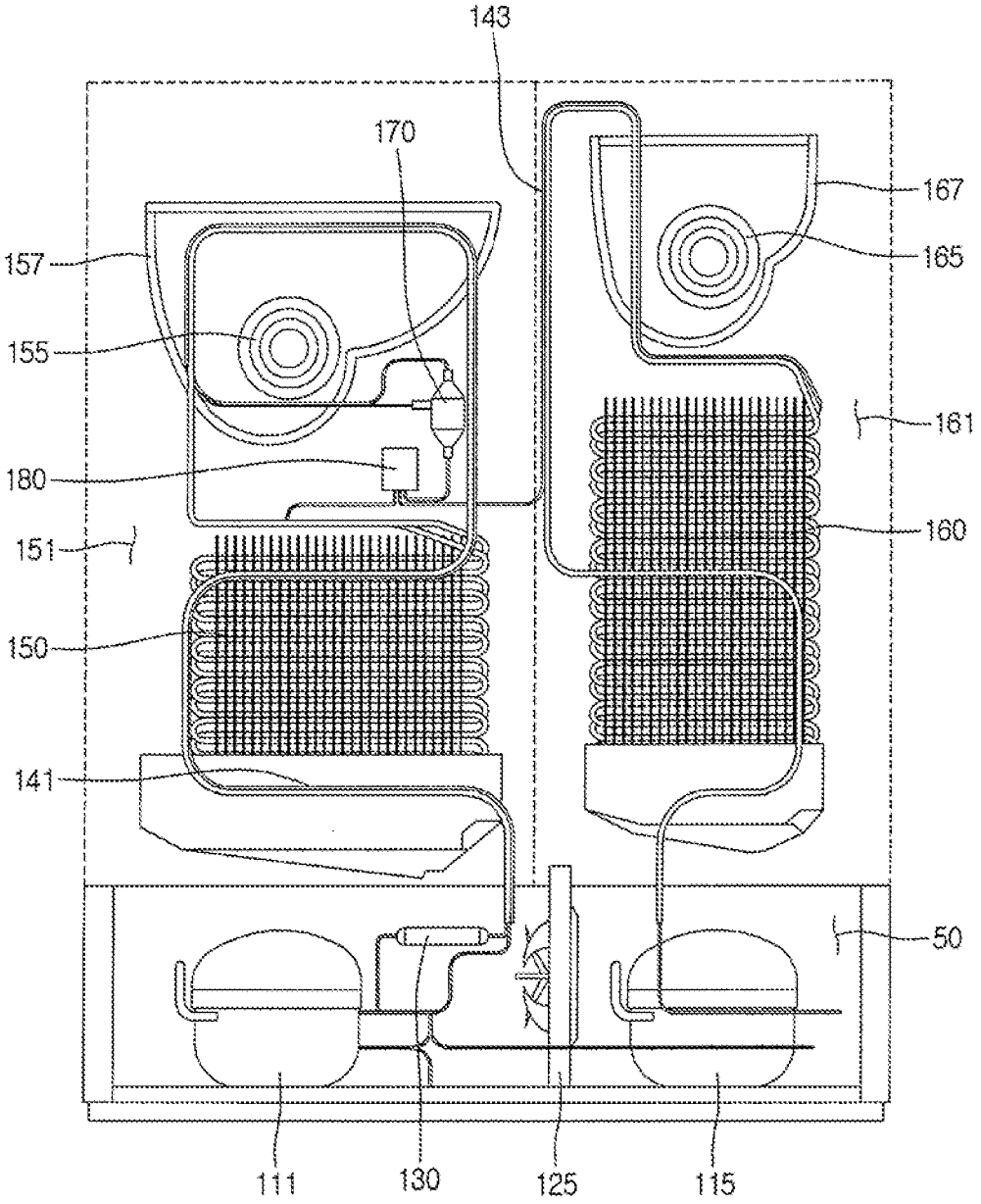
FIG. 4 is a view illustrating a portion of a refrigerator according to an embodiment, when viewed from a rear side.

FIG. 3 is a view illustrating a portion of a refrigerator according to embodiments, when viewed from a front side. FIG. 4 is a view illustrating a portion of the refrigerant according to embodiments, when viewed from a rear side.

Referring to FIGS. 3 and 4, the refrigerator heat-exchange chamber 151, in which the first evaporator 150, may be disposed, and the freezer heat-exchange chamber 161, in which the second evaporator 160 may be disposed, may be provided in a rear wall of the refrigerator main body 20 according to embodiments. The first evaporation fan 155 provided at one side of the first evaporator 150 to circulate cool air, and a first flow guide 157 configured to receive the first evaporation fan 155 therein to guide the cool air passing through the first evaporation fan 155 to the cool air discharge hole 47*b* may be disposed in the refrigerating heat-exchange chamber 151. The second evaporation fan 165 provided at one side of the second evaporator 160 to circulate cool air, and a second flow guide 167 configured to receive the second evaporation fan 165 therein to guide the cool air passing through the second evaporation fan 165 to the cool air discharge hole 49*b* may be disposed in the freezing heat-exchange chamber 161.

A machine room 50 may be defined in a lower portion of the main body 20. The machine room 50 may communicate with an indoor space, in which the refrigerator may be installed, to allow a temperature of the machine room 50 to be at room temperature. The first and second compressors 111 and 115, the condenser 120, the condensation fan 125, and the dryer 130 may be disposed in the machine room 50.

The gas/liquid separator 170 and the flow adjuster 180 may be disposed in the refrigerator heat-exchange chamber 151. The refrigerator heat-exchange chamber 151 may have a relatively low temperature when compared to the temperature of the machine room 50. That is, as the gas/liquid separator 170 and the flow adjuster 180 are installed in a low temperature environment, the refrigerant to be introduced into the first or second evaporator 150 or 160 is not heated increasing a dryness of the refrigerant. Thus, the refrigerant may be improved in evaporation efficiency.

Although the gas/liquid separator 170 and the flow adjuster 180 are shown in FIGS. 3 and 4 disposed in the refrigerator heat-exchange chamber 151, embodiments are not limited thereto. For example, the gas/liquid separator 170 and the flow adjuster 180 may be disposed in the freezer heat-exchange chamber 161.

The first expansion device 141 may be disposed in the refrigerator heat-exchange chamber 151, and the second expansion device 143 may be disposed in the freezer heat-exchange chamber 161.

Figure 5:
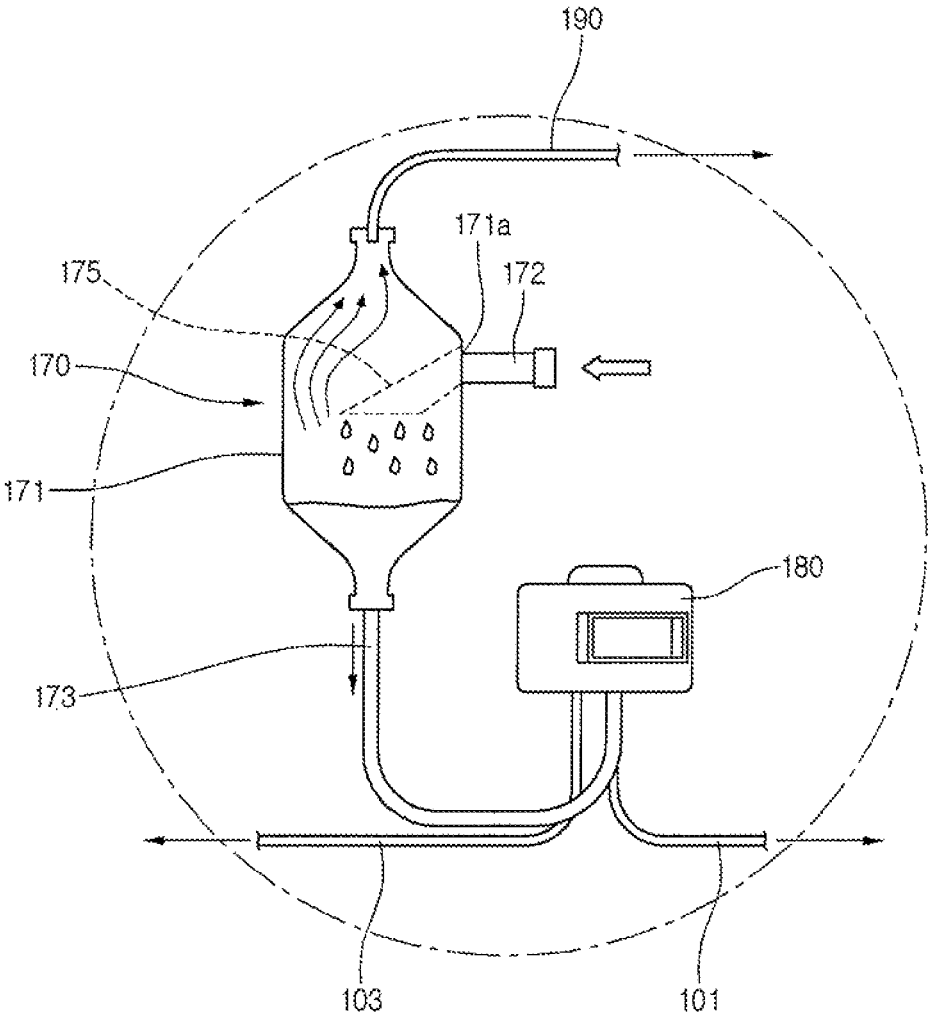
FIG. 5 is an enlarged view illustrating portion A of FIG. 3.
Figure 6:
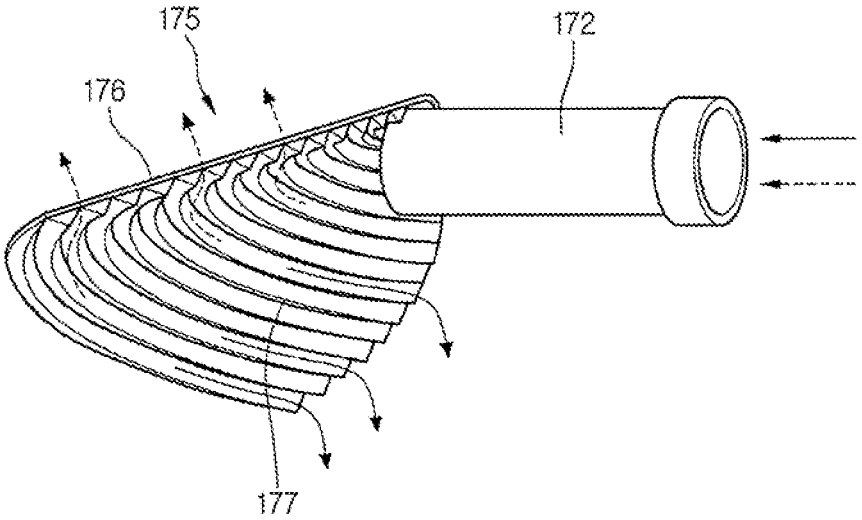
FIG. 6 is a schematic diagram of inner components of a gas/liquid separator according to an embodiment.

FIG. 5 is an enlarged view illustrating portion A of FIG. 3. FIG. 6 is a schematic diagram of inner components of the gas/liquid separator according to an embodiment.

Referring to FIGS. 5 and 6, the gas/liquid separator 170 according to an embodiment may include a gas/liquid separator body 171 that defines a storage space for the refrigerant, and a separator 175 disposed in the gas/liquid separation body to separate the refrigerant into liquid refrigerant and gaseous refrigerant. The inflow tube 172 may be connected to an approximately central portion of the gas/liquid separator body 171. An inflow coupling device 171*a* coupled to the inflow tube 172 may be disposed in the gas/liquid separator body 171.

The separator 175 may be disposed adjacent to an inside of the inflow coupling device 171*a*, so that the refrigerant collides with the separator 175 when the refrigerant is introduced through the inflow coupling device 171*a*. In detail, the separator 175 may include a separator body 176 disposed to face the inflow coupling device 171*a*, and at least one groove 177 defined in a surface of the separator body 176 to guide separation of the refrigerant.

The separator body 176 may be rounded to easily separate the liquid refrigerant and the gaseous refrigerant from each other when the refrigerant collides with the separator body 176. Thus, the separator body 176 may be referred to as a "collision plate".

A plurality of the grooves 177 may be provided, and the plurality of grooves 177 may be spaced apart from each other. Also, the at least one groove 177 may be smoothly inclined downward to guide downward discharge of the liquid refrigerant.

According to the above-described structure, when the refrigerant is introduced into the gas/liquid separator 170, the refrigerant may collide with the separator body 176. Thus, the gaseous refrigerant (solid arrow) having a relatively low specific gravity may flow upward, and the liquid refrigerant (droplets) having a relatively high specific gravity may be guided to flow downward along the groove at least one 177.

The liquid discharge 173 may be connected to a lower portion of the gas/liquid separator body 171, and the gaseous refrigerant discharge 190 may be connected to an upper portion of the gas/liquid separator body 171. The liquid discharge 173 may be connected to the flow adjuster 180. Also, the first and second refrigerant passages 101 and 103 to branch the refrigerant may be connected to the flow adjuster 180.

Figure 7:
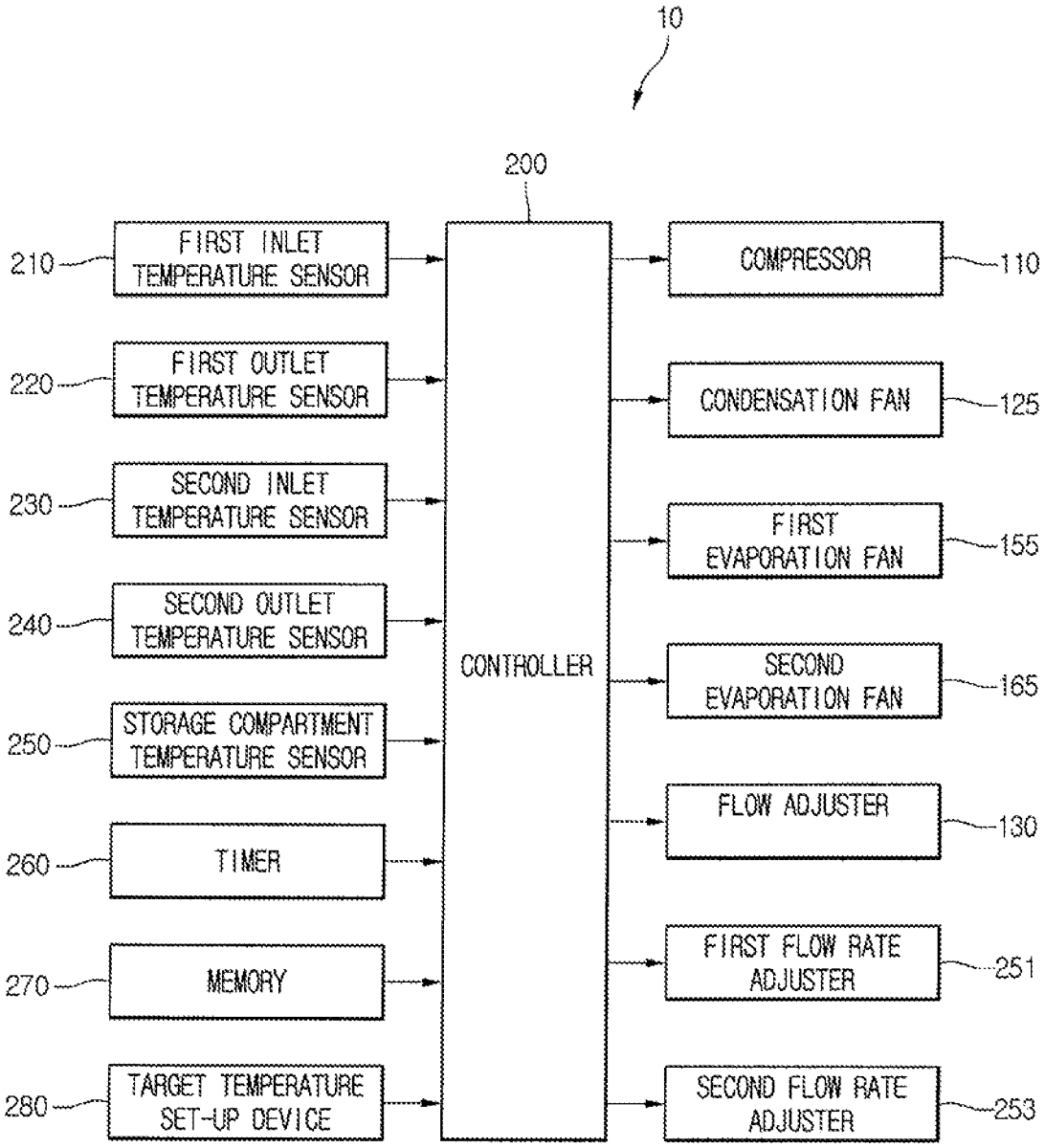
FIG. 7 is a block diagram of a refrigerator according to an embodiment.
Figure 8:
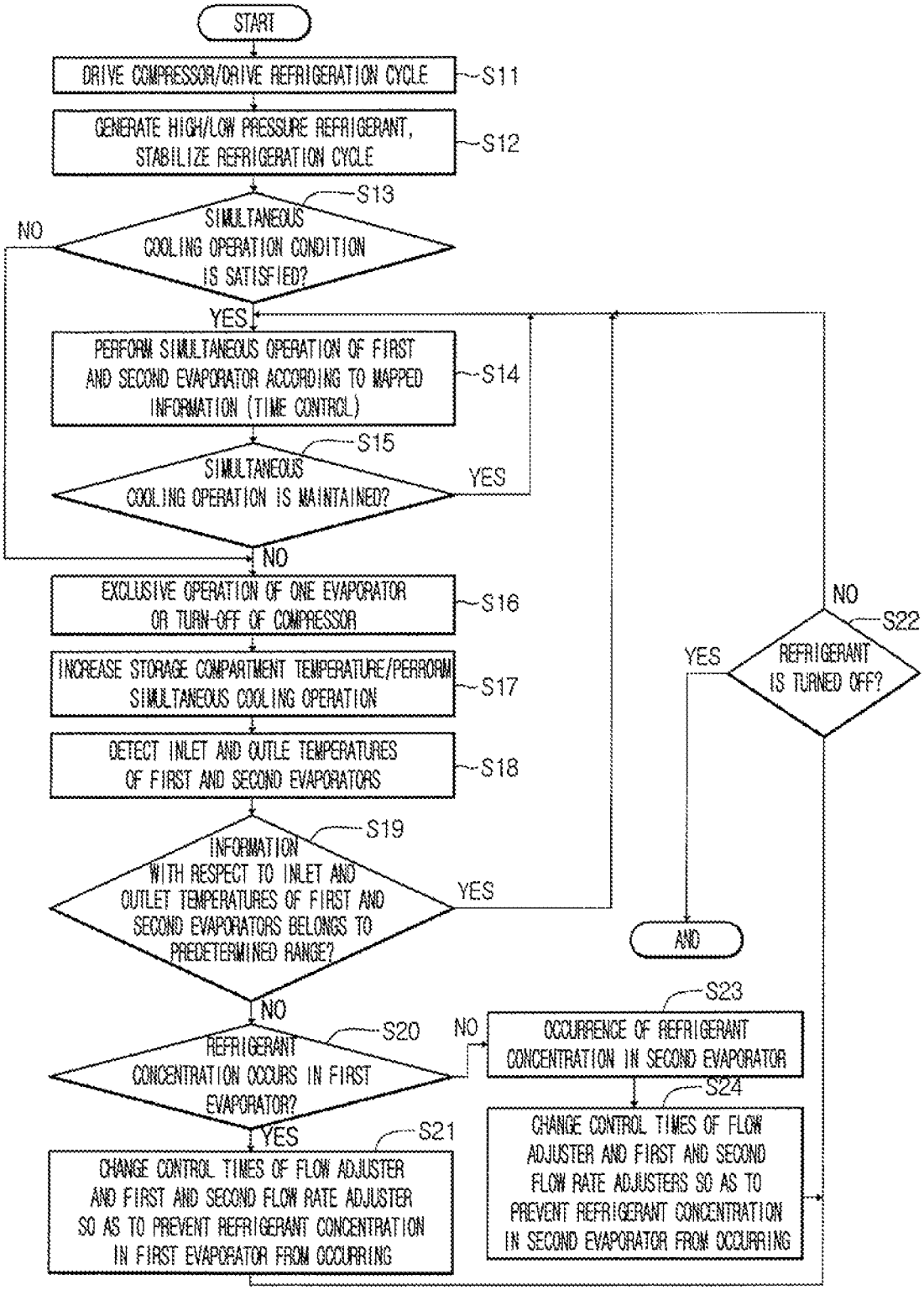
FIG. 8 is a flowchart of a method for controlling a refrigerator according to an embodiment.

FIG. 7 is a block diagram of a refrigerator according to an embodiment. FIG. 8 is a flowchart of a method for controlling a refrigerator according to an embodiment.

Referring to FIG. 7, refrigerator 10 according to an embodiment may include a plurality of temperature sensors 210, 220, 230, and 240 to detect inlet or outlet temperatures of each of the first and second evaporators 150 and 160. The plurality of temperature sensors 210, 220, 230, and 240 may include a first inlet temperature sensor 210 to detect an inlet-side temperature of the first evaporator 150, and a first outlet temperature sensor 220 to detect an outlet-side temperature of the first evaporator 150. The plurality of temperature sensors 210, 220, 230, and 240 may further include a second inlet temperature sensor 230 to detect an inlet-side temperature of the second evaporator 160, and a second outlet temperature sensor 240 to detect an outlet-side temperature of the second evaporator 160. The refrigerator 10 may further include a controller 200 that controls an operation of the flow adjuster 130 on the basis of temperatures detected by the plurality of temperature sensors 210, 220, 230, and 240.

To perform simultaneous cooling operations of the refrigerator and freezer compartments, the controller 200 may control operations of the compressor 110, the condensation fan 125, and the first and second evaporation fans 155 and 165. The compressor 110 may include compressor 111 and second compressor 115.

The refrigerator 10 may further include a storage compartment temperature sensor 250 to detect an inner temperature of the refrigerator storage compartment. The storage compartment temperature sensor 250 may include a refrigerator compartment temperature sensor disposed in the refrigerator compartment to detect an inner temperature of the refrigerator compartment, and a freezer compartment temperature sensor disposed in the freezer compartment to detect an inner temperature of the freezer compartment.

Also, the refrigerator 10 may include a target temperature set-up device 280 to receive input of a target temperature of the refrigerator compartment or the freezer compartment by a user. For example, the target temperature set-up device 280 may be disposed on or at a position at which it is easily manipulated by a user, such as on a front surface of the refrigerator compartment door or the freezer compartment door.

The information input through the target temperature set-up device 280 may be control reference information of the compressor 110, the plurality of blower fans 125, 155, and 165, and the flow adjuster 130. That is, the controller 200 may determine a simultaneous cooling operation of the refrigerator compartment and the freezer compartment, an exclusive operation of one storage compartment, or turn-off of the compressor 110 on the basis of the information input by the target temperature set-up device 280 and the information detected by the storage compartment temperature sensor 250.

For example, if inner temperatures of the refrigerator compartment and the freezer compartment are higher than that input through the target temperature set-up device 280, the controller 200 may control the compressor 110 and the flow adjuster 130 to perform the simultaneous cooling operation. On the other hand, if the inner temperature of the freezer compartment is higher than that input through the target temperature set-up device 280, and the inner temperature of the refrigerator compartment is lower than that input through the target temperature set-up device 280, the controller 200 may control the compressor 110 and the flow adjuster 130 to perform an exclusive cooling operation for the freezer compartment. Also, when the inner temperatures of the refrigerator compartment and the freezer compartment are lower than that input through the target temperature set-up device 280, the controller 200 may turn the compressor 110 off.

The refrigerator 10 may further include a timer 260 to determine a time elapsed value for the operation of the flow adjuster 130 while the simultaneous cooling operation of the refrigerator compartment and the freezer compartment is performed. For example, the timer 240 may determine a time elapsed in a state in which all of the first and second refrigerant passages 101 and 103 are open, or a time elapsed in a state in which one of the first and second refrigerant passages 101 and 103 is open.

The refrigerator 10 may further include a memory 270 to store time values mapped with respect to adjusted states of the flow adjuster 130 and the first and second flow rate adjusters 251 and 253, and to previously store the mapped values while the simultaneous cooling operation of the refrigerator compartment and the freezer compartment is performed.

In detail, in this embodiment, information mapped as shown in Table 1 below may be stored in the memory 270.

TABLE 1

| Refrigerant concentration | Case 1 | Case 2 |
|---|---|---|
| Simultaneous cooling operation start (reference value) | 90 seconds | 90 seconds |
| When refrigerant concentration occurs in first evaporator | 90 seconds | 120 seconds |
| When refrigerant concentration occurs in second evaporator | 90 seconds | 60 seconds |

Referring to Table 1 above, "case 1" may be understood as a first control state (an adjusted state) of the flow adjuster 130 and the first and second flow adjuster 251 and 252, that is, a state in which an amount of refrigerant flowing into the first refrigerant passage 101 is greater than an amount of refrigerant flowing into the second refrigerant passage 103. In detail, case 1 may be a state in which the flow adjuster 130 is adjusted to open both of the first and second refrigerant passages 101 and 103, and an opening degree of the first flow rate adjuster 251 is adjusted so an opening degree of the first flow rate adjuster 251 is greater than an opening degree of the second flow rate adjuster 253.

The case 1 may include a state in which the first flow rate adjuster 251 is open, and the second flow rate adjuster 253 is closed in a state in which the opening degree of the first flow rate adjuster 251 is greater than the opening degree of the second flow rate adjuster 253, or a state in which the opening degree of the first flow rate adjuster 251 is greater than the opening degree of the second flow rate adjuster 253 in a state in which both of the first and second flow rate adjusters 251 and 253 are open.

On the other hand, "case 2" may be understood as a second control state (an adjusted state) of the flow adjuster 180 and the first and second flow adjusters 251 and 252, that is, a state in which an amount of refrigerant flowing into the second refrigerant passage 103 is greater than an amount of refrigerant flowing into the first refrigerant passage 101. In detail, case 2 may be a state in which the flow adjuster 130 is adjusted to open both of the first and second refrigerant passages 101 and 103, and an opening degree of the second flow rate adjuster 253 is adjusted so that the opening degree of the second flow rate adjuster 253 is greater than the opening degree of the first flow rate adjuster 251.

The case 2 may include a state in which the second flow rate adjuster 253 is open, and the first flow rate adjuster 251 is closed in a state in which the opening degree of the second flow rate adjuster 253 is greater than the opening degree of the first flow rate adjuster 251, or a state in which the opening degree of the second flow rate adjuster 253 is greater than the opening degree of the first flow rate adjuster 251 in a state in which both of the first and second flow rate adjusters 251 and 253 are open.

For example, if simultaneous cooling operation conditions are satisfied, it may be recognized that the cooling operation is required for both the refrigerator compartment and the freezer compartment. Thus, the simultaneous cooling operation may start. The controller 200 may maintain the first control state for about 90 seconds, and then, may maintain the second control state for about 90 seconds. The first and second control states may be alternately performed if it unnecessary to perform the simultaneous cooling operation.

While the first and second control states are repeatedly performed, when the inner temperature of the refrigerator compartment or the freezer compartment reaches a target temperature, supply of the refrigerant into at least one evaporator may be stopped (exclusive one evaporator operation). Also, when the inner temperatures of the refrigerator compartment and the freezer compartment both reach the target temperature, the compressor 110 may be turned off.

When the exclusive one evaporator operation or the turn-off of the compressor 110 are maintained for a predetermined period of time, and it is needed to perform the simultaneous cooling operation of the refrigerator compartment and the freezer compartment, the controller 200 may determine whether refrigerant concentration in the first or second evaporator 150 or 160 occurs on the basis of the plurality of temperature values detected by the temperature sensors 210, 220, 230, and 240. If it is determined that refrigerant concentration in the first evaporator 150 occurs, the controller 200 may change the time values according to the first and second cases 1 and 2 and apply the changed time values. That is, when refrigerant concentration in the first evaporator occurs, as a time taken to supply the refrigerant into the second evaporator 160 has to relatively increase, a control time with respect to the case 2 may increase (about 10 seconds). On the other hand, when refrigerant concentration in the second evaporator occurs, as a time taken to supply the refrigerant into the first evaporator 150 has to relatively increase, a control time with respect to the case 2 may decrease (about 60 seconds).

That is, if it is determined that refrigerant concentration in one evaporator occurs, the control time with respect to case 2 may be adjusted to prevent the refrigerant concentration in the evaporator from occurring. It may be determined that a cooling load of the storage compartment in which the second evaporator 160 is disposed is less than a cooling load of the storage compartment in which the first evaporator 150 is disposed. As a result, the control time with respect to case 1 for increasing supply of the refrigerant into the storage compartment having the relatively large cooling load may be fixed, and the control time with respect to case 2 for increasing supply of the refrigerant into the storage compartment having the relatively small cooling load may be changed. Thus, the storage compartment having the large cooling load may be stably maintained in cooling efficiency.

The control time of each of the flow adjuster 130 and the first and second flow rate adjusters 251 and 253 according to case 1 may be referred to as a "first set-up time", and the control time of each of the flow adjuster 130 and the first and second flow rate adjusters 251 and 253 may be referred to as a "second set-up time".

In Table 1 above, the information with respect to the time value for successively performing cases 1 and 2 while the simultaneous cooling operation is performed, and the changing time for successively performing cases 1 and 2 when refrigerant concentration in the one evaporator occurs may be obtained through repeated experiments.

Referring to FIG. 8, a method for controlling a refrigerator according to an embodiment will be described. To drive the refrigerator 10, the compressor 110 (first and second compressors 111 and 115) may be driven. A refrigeration cycle according to the compression-condensation-expansion-evaporation of the refrigerant may operate according to the driving of the compressor 110 (first and second compressors 111 and 115). The refrigerant evaporated in the second evaporator 160 may be compressed in the second compressor 115, and the compressed refrigerant may be mixed with the refrigerator evaporated in the first evaporator 150, and then, the mixture may be introduced into the first compressor 111, in step S11.

The simultaneous cooling operation of the refrigerator compartment and the freezer compartment may be initially performed according to the operation of the refrigeration cycle. When a predetermined period of time has elapsed, a pressure value according to the refrigerant circulation may reach a preset or predetermined range. That is, a high pressure of the refrigerant discharged from the first and second compressors 111 and 115 and a low pressure of the refrigerant discharged from the first and second evaporators 150 and 160 may be set within the preset or predetermined range.

When the high and low pressures of the refrigerant are set within the preset or predetermined range, the refrigeration cycle may be stabilized to continuously operate. A target temperature of the storage compartment of the refrigerator may be previously set, in step S12.

While the refrigeration cycle operates, it is determined whether simultaneous cooling operation conditions of the refrigerator compartment and the freezer compartment are satisfied. For example, if it is determined that the inner temperature of the refrigerator compartment and the freezer compartment is above the target temperature through the value detected by the storage compartment temperature sensor 250, the simultaneous cooling operation of the refrigerator compartment and the freezer compartment may be performed, in step S13.

When the simultaneous cooling operation is performed, simultaneous operation of the first and second evaporators 150 and 160 may be performed according to the previously mapped information. That is, the flow adjuster 130 may be controlled in operation to simultaneously supply the refrigerant into the first and second evaporators 150 and 160.

As shown in Table 1 above, in the flow adjuster 130 and the first and second flow rate adjusters 251 and 253, the first adjustment state according case 1 may be maintained for about 90 seconds, and the second adjustment state according to case 2 may be maintained for about 90 seconds. That is, a time control operation to prevent refrigerant concentration into the second evaporator 160 from occurring may be performed first according to case 1, and then, a time control operation to prevent refrigerant concentration into the first evaporator 150 from occurring may be performed according to case 2, in step S14.

When the simultaneous cooling operation according to cases 1 and 2 is performed once or more, maintenance of the simultaneous cooling operation of the refrigerator compartment and the freezer compartment may be determined. In detail, whether the temperature of the refrigerator compartment or the freezer compartment reaches the target temperature may be detected through the storage compartment temperature sensor 250.

If the temperature of the refrigerator compartment or the freezer compartment reaches the target temperature, it may be unnecessary to perform the cooling of the corresponding storage compartment, and thus, it may be unnecessary to perform the simultaneous cooling operation. Thus, when the exclusive cooling operation of the storage compartment, which does not reach the target temperature that is, the exclusive cooling operation of the evaporator of the corresponding storage compartment is performed, if all of the storage compartments reach the target temperature, the compressor 110 may be turned off. On the other hand, if both of the temperatures of the refrigerator compartment and the freezer compartment do not reach the target temperature, the process may return to step S14 to again perform the simultaneous operation of the first and second evaporators 150 and 160. The simultaneous operation may be repeatedly performed until at least one of the refrigerator compartment or the freezer compartment reaches the target temperature.

As described above, while the simultaneous operation of the first and second evaporators 150 and 160 is performed, controls of the flow adjuster 130 and the first and second flow rate adjusters 251 and 253 according to cases 1 and 2 may be successively performed to prevent refrigerant concentration from occurring in the first and second evaporators 150 and 160, thereby improving cooling efficiency of the storage compartment and operation efficiency of the refrigerator, in steps S15 and S16.

In step S16, when a time has elapsed in a state in which exclusive operation of one evaporator is performed, or the compressor 110 is turned off, the refrigerator compartment and the freezer compartment may increase in temperature. When the temperature of the refrigerator compartment or the freezer compartment increases to a temperature out of the target temperature range, it may be necessary to cool the storage compartment that increases in temperature or to operate the compressor 110 that is in the turned-off state. Also, the simultaneous cooling operation of the refrigerator compartment and the freezer compartment may be performed again, in step S17.

While the simultaneous cooling operation is performed again, change in the control times of the flow adjuster 130 and the first and second flow rate adjusters 251 and 253 according to cases 1 and 2 may be determined. In detail, inlet and outlet temperatures of the first evaporator 150 may be detected by the first inlet and outlet temperature sensors 210 and 220. Also, inlet and outlet temperatures of the second evaporator 160 may be detected by the second inlet and outlet temperature sensors 230 and 240, in step S18. The controller 200 may determine an inlet/outlet temperature difference value of the first evaporator 150 and an inlet/outlet temperature difference value of the second evaporator 160.

When an amount of refrigerant introduced into the first or second evaporator 150 or 160 is above an adequate refrigerant amount, a difference value between the inlet and outlet temperatures of the first or second evaporator 150 and 160 may decrease. On the other hand, when an amount of refrigerant introduced into the first or second evaporator 150 or 160 is below the adequate refrigerant amount, the difference value between the inlet and outlet temperatures of the first or second evaporator 150 or 160 may increase.

The controller 200 may determine whether information with respect to the difference value between the inlet and outlet temperatures of the first or second evaporator 150 or 160 belongs to a preset or predetermined range. That is, the controller 200 may determine whether an amount of refrigerant flowing into the first or second evaporator 150 or 160 is excessive or lacking, that is, whether the refrigerant is concentrated into the first or second evaporator 150 or 160, on the basis of the inlet/outlet temperature difference of the first evaporator 150 and the inlet/outlet temperature difference of the second evaporator 160. In detail, whether the amount of refrigerant flowing into the first or second evaporator 150 or 160 is excessive or lacking may be determined on the basis of the inlet/outlet temperature difference of the first evaporator 150, the inlet/outlet temperature difference of the second evaporator 160, or a ratio of the inlet/outlet temperature differences of the first and second evaporators 150 and 160, in step S19.

Hereinbelow, a detailed determination method will be described.

As an example of a determination method, it may be determined whether the refrigerant is concentrated according to whether the inlet/outlet temperature difference of the first evaporator 150 is equal to or greater or less than a preset or predetermined reference valve. The refrigerant circulated into the refrigeration cycle may be branched into the first and second evaporators 150 and 160 through the flow adjuster 130. Thus, when the inlet/outlet temperature difference of the first evaporator 150 is detected, a rate of the refrigerant passing through the first evaporator 150 may be determined. A rate of the refrigerant passing through the second evaporator 160 may be determined on the basis of the rate of the refrigerant passing through the first evaporator 150.

For example, when the inlet/outlet temperature difference of the first evaporator 150 is greater than the reference value, it may be determined that an amount of refrigerant is lacking. On the other hand, it may be recognized that an amount of refrigerant flowing into the second evaporator 160 is relatively large.

In this embodiment, a method for determining a refrigerant concentration phenomenon using the inlet/outlet temperature difference of the first evaporator will be described hereinbelow. Of course, the refrigerant concentration phenomenon may be determined using the inlet/outlet temperature difference of the second evaporator.

If the inlet/outlet temperature difference of the first evaporator 150 is equal to the preset or predetermined reference value (a reference temperature), it may be determined that the refrigerant concentration into the first or second evaporator 150 or 160 may not occur. In this case, the process may return to step S14, and then, the flow adjuster 130 may be controlled on the basis of the time value set when the simultaneous cooling operation starts. That is, each of the adjusted states according to cases 1 and 2 may be maintained for about 90 seconds. Then, steps S15 to S18 may be performed again.

On the other hand, if the inlet/outlet temperature difference of the first evaporator 150 is not equal to the preset or predetermined reference value or is greater or less than the reference value, it may be determined that the refrigerant concentration into the first or second evaporator 150 or 160 occurs. In detail, if the inlet/outlet temperature difference of the first evaporator 150 is less than the preset or predetermined reference value, it may be determined that a relatively large amount of refrigerant passes through the first evaporator 150. That is, it may be determined that refrigerant concentration into the first evaporator 150 occurs.

This case may correspond to "the occurrence of the refrigerant concentration in the first evaporator" shown in Table 1, and thus, the control state according to case 1 may be maintained for about 90 seconds, and the control state according to case 2 may be increased to about 120 seconds. That is, as the adjusting time according to case 2 increases in preparation for the "simultaneous cooling operation start", an amount of refrigerant introduced into the first evaporator 150 may relatively decrease, in steps S20 and S21.

On the other hand, if the inlet/outlet temperature difference of the first evaporator 150 is greater than the preset or predetermined reference value, it may be determined that a relatively small amount of refrigerant passes through the first evaporator 150. That is, it may be determined that refrigerant concentration into the second evaporator 160 occurs.

This case may correspond to "the occurrence of the refrigerant concentration in the first evaporator" shown in Table 1, and thus, the control state according to case 2 may be maintained for about 90 seconds, and the control state according to case 2 may be decreased to about 60 seconds. That is, as the adjusting time of the flow adjuster 130 and the first and second flow rate adjusters 251 and 253 according to case 2 decreases in preparation for the "simultaneous cooling operation start", an amount of refrigerant introduced into the first evaporator 150 may relatively increase, in steps S23 and S24.

When the control times of the flow adjuster 130 and the first and second flow rate adjusters 251 and 253 are changed by the above-described method, processes after step S14 may be performed again on the basis of the changed control time values unless the refrigerator is turned off, in step S22.

As described above, as the control times of the flow adjuster 130 and the first and second flow rate adjusters 251 and 253 are changed on the basis of the information with respect to the inlet and outlet temperature difference of the first and second evaporators 150 and 160, refrigerant concentration in the first and second evaporators 150 and 160 may be prevented.

As another example of a determination method in step S19, it may be determined whether the refrigerant is concentrated according to whether the inlet/outlet temperature difference of the first evaporator 150 is equal to or is greater or less than a first set or predetermined valve. For example, the first set value may be 1.

When a ratio of the inlet/outlet temperature difference of the first evaporator 150 to the inlet/outlet temperature difference of the second evaporator 160 is 1, that is, the inlet/outlet temperature differences of the first and second evaporators 150 and 160 are the same, it may be determined that refrigerant concentration phenomenon does not occur in the first or second evaporator 150 or 160. On the other hand, when a ratio of the inlet/outlet temperature difference of the first evaporator 150 to the inlet/outlet temperature difference of the second evaporator 160 is greater than 1, that is, the inlet/outlet temperature difference of the first evaporator 150 is greater than that of the second evaporator 160 it may be determined that refrigerant concentration does not occur in the second evaporator 160. Also, when a ratio of the inlet/outlet temperature difference of the first evaporator 150 to the inlet/outlet temperature difference of the second evaporator 160 is greater than 1, that is, inlet/outlet temperature difference of the first evaporator 150 is greater than that of the second evaporator 160, it may be determined that refrigerant concentration does not occur in the second evaporator 150.

As a further example of a determination method in step S19, it may be determined whether the refrigerant is concentrated according to whether a difference value between the inlet/outlet temperature difference of the first evaporator 150 and the inlet/outlet temperature difference of the second evaporator 160 is equal to a second set or predetermined value, or is greater or less than the second set value. For example, the first set value may be 0.

When a value obtained by subtracting the inlet/outlet temperature difference of the second evaporator 160 from the inlet/outlet temperature difference of the first evaporator 150 is 0, that is, the inlet/outlet temperature differences of the first and second evaporators 150 and 160 are the same, it may be determined that refrigerant concentration does not occur in the first or second evaporator 150 or 160. On the other hand, when a ratio of the inlet/outlet temperature difference of the first evaporator 150 to the inlet/outlet temperature difference of the second evaporator 160 is greater than 1, that is, the inlet/outlet temperature difference of the first evaporator 150 is greater than that of the second evaporator 160, it may be determined that refrigerant concentration does not occur in the second evaporator 160. Also, when a ratio of the inlet/outlet temperature difference of the first evaporator 150 to the inlet/outlet temperature difference of the second evaporator 160 is less than 0, that is, the inlet/outlet temperature difference of the first evaporator 150 is less than that of the second evaporator 160, it may be determined that refrigerant concentration does not occur in the first evaporator 150.

As described, as the opening degree of each of the flow adjuster 130 and the first and second flow rate adjusters 251 and 253 may be controlled to adjust an amount of refrigerant passing through the first and second refrigerant passages 101 and 103, refrigerant concentration into the first or second evaporator 150 or 160 may be prevented to improve cooling efficiency and reduce power consumption.

According to embodiments disclosed herein, as the gas/liquid separator may be disposed on or at the inlet-side of the evaporator to separate the liquid refrigerant of the two-phase refrigerant decompressed in the first expansion device, thereby supplying the separated liquid refrigerant into the first or second evaporator, a dryness fraction of the refrigerant introduced into the evaporator may be reduced. Also, as the dryness fraction of the refrigerant introduced into the evaporator may be reduced, heat-exchange efficiency may be improved, and thus, power consumption may be improved.

Further, as the gaseous refrigerant separated in the gas/liquid separator may be supplied into the refrigeration cycle through the outlet-side of the first evaporator, leaking of refrigerant may be prevented. Also, as the gas/liquid separator and the flow adjuster may be disposed at a rear side of the cooling chamber, rather than in the machine room having a high temperature, increase in the dryness fraction due to heating of the refrigerant introduced into the evaporator may be prevented. Additionally, as the separation device having the groove may be disposed in the gas/liquid separator, gaseous refrigerant and liquid refrigerant of two-phase refrigerant introduced into the gas/liquid separator may be easily separated.

Also, as an amount of refrigerant supplied into the plurality of evaporators may be adjustable on the basis of the previously determined time value and inlet and outlet temperature difference of the plurality of evaporators while the refrigerant operates, distribution of refrigerant into the plurality of evaporators may be effectively realized. As a result, a first control process to increase an amount of refrigerant supplied into one evaporator of the plurality of evaporators, and a second control process to increase an amount of refrigerant supplied into the other evaporator of the plurality of evaporators may be performed according to the time period set during the simultaneous cooling operation.

Moreover, as the inlet and outlet temperature information of the first and second evaporators may be confirmed to change control time values in first and second control processes, refrigerant concentration into a specific evaporator of the plurality of evaporators may be prevented to realize precision control. As the flow rate adjuster, an opening degree of which is adjustable, may be provided in the plurality of refrigerant passages, a flow rate of the refrigerant may be accurately controlled.

Embodiments disclosed herein provide a refrigerator having improved operation efficiency in comparison to the related art.

Embodiments disclosed herein provide a refrigerator that may include at least one compressor that compresses a refrigerant; a condenser that condenses the refrigerant compressed in the compressor; a first expansion device that decompresses the refrigerant condensed in the condenser; a gas/liquid separator that separates the refrigerant decompressed in the first expansion device into a liquid refrigerant and a gaseous refrigerant; first and second evaporators, into which the liquid refrigerant separated in the gas/liquid separator may be introduced; and a second expansion device disposed at an inlet-side of the second evaporator to decompress the refrigerant. The refrigerator may further include a flow adjustment part or flow adjuster disposed on or at an inlet-side of the first and second evaporators to introduce the liquid refrigerant into at least one evaporator of the first and second evaporators.

The refrigerator may further include a first refrigerant passage that extends from the flow adjustment part to the first evaporator, and a second refrigerant passage that extends from the flow adjustment part to the second evaporator. The refrigerator may further include a temperature sensor that detects temperatures of an inlet and outlet of the first evaporator and temperatures of an inlet and outlet of the second evaporator; a memory, in which information with respect to a control time according to a variation in amount of refrigerant flowing into the first refrigerant passage or the second refrigerant passage is mapped and stored; and a control unit or controller that controls supply of the refrigerant into the first and second evaporators on the basis of the information mapped in the memory, wherein a change in control time may be determined on the basis of the information detected by the temperature sensor.

The information with respect to the control time may include information with respect to a first set-up time, at which time an amount of refrigerant supplied into the first evaporator increases to prevent the refrigerant from being concentrated into the second evaporator, and information with respect to a second set-up time, at which time an amount of refrigerant supplied into the second evaporator to prevent the refrigerant from being concentrated into the first evaporator. The control unit may increase the second set-up time when refrigerant concentration into the first evaporator is determined, and decrease the second set-up time when refrigerant concentration into the second evaporator is determined according to the information detected by the temperature sensor.

The refrigerator may further include a first flow rate adjustment part or flow adjuster disposed in the first refrigerant passage, and a second flow rate adjustment part or flow adjuster disposed in the second refrigerant passage. The information with respect to the control time may include time information with respect to operation states of the flow adjustment part and the first and second flow rate adjustment parts.

An opening degree of the first flow adjustment part may be maintained so that the opening degree of the first flow adjustment part is greater than an opening degree of the second flow adjustment part to increase an amount of refrigerant supplied into the first evaporator, and the opening degree of the second flow adjustment part may be maintained so that the opening degree of the second flow adjustment part is greater than the opening degree of the first flow adjustment part to increase an amount of refrigerant supplied into the second evaporator.

The refrigerator may further include a main body including the refrigerator compartment and the freezer compartment. The first evaporator may be a refrigerator compartment evaporator that cools the refrigerator compartment, and the second evaporator may be a freezer compartment evaporator that cools the freezer compartment.

The refrigerator may further include a liquid discharge part or discharge that discharges the liquid refrigerant separated from the gas/liquid separator, the liquid discharge part extending to the flow adjustment part, and a gaseous refrigerant discharge part or discharge that discharges the gaseous refrigerant separated from the gas/liquid separator, the gaseous refrigerant discharge part extending to an outlet-side of the first evaporator.

The gas/liquid separator may include a gas/liquid separation body including an inflow coupling part or device coupled to an inflow tube of the refrigerant, and a separation device disposed within the gas/liquid separation body to separate the introduced refrigerant into the liquid refrigerant and the gaseous refrigerant. The separation device may include a separation body disposed to face the inflow coupling part, and at least one groove part or groove defined in a surface of the separation body. The groove part may roundly extend downward to guide downward discharge of the liquid refrigerant.

The main body may include an outer case, an inner case, and a rear panel that covers the inner case. The gas/liquid separator may be disposed in a heat-exchange chamber defined between the inner case and the rear panel. The flow adjustment part may be disposed in a heat-exchange chamber defined between the inner case and the rear panel.

Embodiments disclosed herein further provide a refrigerator that may include first and second compressors that compress a refrigerant; a condenser that condenses the refrigerant compressed in the first and second compressors; a first capillary that decompresses the refrigerant condensed in the condenser; a gas/liquid separator that receives the refrigerant decompressed in the first capillary; a liquid discharge part or discharge that extends from a lower portion of the gas/liquid separator; a gaseous refrigerant discharge part or discharge that extends from an upper portion of the gas/liquid separator; a flow adjustment part or flow adjuster connected to the liquid discharge part; first and second refrigerant passages branched from the liquid discharge part; a refrigerator compartment evaporator disposed in the first refrigerant passage; and a freezer compartment evaporator disposed in the second refrigerant passage. The refrigerator may further include a second capillary disposed in the second refrigerant passage to compress the refrigerant. The gaseous refrigerant discharge part may include a bypass passage connected to an outlet-side of the refrigerator compartment evaporator.

The refrigerator may further include a first flow rate adjustment part or flow rate adjuster disposed in the first refrigerant passage; a second flow rate adjustment part or flow rate adjuster disposed in the second refrigerant passage; and a control unit or controller that controls operations of the flow adjustment part and the first and second flow rate adjustment parts on the basis of a preset or predetermined control time to change an amount of refrigerant flowing into the first refrigerant passage or the second refrigerant passage. The refrigerator may further include a temperature sensor that detects inlet and outlet temperatures of the first evaporator or inlet and outlet temperatures of the second evaporator. The control unit may determine whether the preset control time is changed on the basis of the information detected by the temperature sensor.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a plurality of compressors that compresses a refrigerant, wherein the plurality of compressors includes a first compressor and a second compressor, wherein the second compressor is disposed at a low pressure side, and wherein the first compressor compresses a refrigerant compressed at the second compressor;

a condenser that condenses the refrigerant compressed in at least one of the plurality of compressors;

a first expansion device that decompresses the refrigerant condensed in the condenser;

a gas/liquid separator that separates the refrigerant decompressed in the first expansion device into liquid refrigerant and gaseous refrigerant;

first and second evaporators, into which the liquid refrigerant separated in the gas/liquid separator is introduced;

a flow adjuster disposed at an inlet-side of the first and second evaporators to introduce the liquid refrigerant separated in the gas/liquid separator into at least one evaporator of the first and second evaporators;

a liquid refrigerant discharge disposed at a side of the gas/liquid separator to discharge the liquid refrigerant separated in the gas/liquid separator, the liquid refrigerant discharge configured to extend to the flow adjuster;

a gaseous refrigerant discharge that discharges the gaseous refrigerant separated from the gas/liquid separator, and extends to an outlet-side of the first evaporator; and a second expansion device disposed at an inlet-side of the second evaporator to decompress the refrigerant, wherein an outlet side refrigerant pipe of the second evaporator extends to an inlet of the second compressor such that the refrigerant passed through the second evaporator is introduced into the second compressor, wherein an outlet side refrigerant pipe of the first evaporator is connected to an outlet side of a refrigerant pipe of the second compressor such that the refrigerant passed through the first evaporator joins the refrigerant compressed at the second compressor and is introduced into the first compressor, and wherein the refrigerant compressed at the first compressor is introduced into the condenser.

2. The refrigerator according to claim 1, further comprising:

a first refrigerant passage that extends from the flow adjuster to the first evaporator; and a second refrigerant passage that extends from the flow adjuster to the second evaporator.

3. The refrigerator according to claim 2, further comprising:

at least one temperature sensor that detects at least one of temperatures of an inlet and outlet of the first evaporator and temperatures of an inlet and outlet of the second evaporator;

a memory, in which information with respect to a control time according to a variation in amount of the refrigerant flowing into the first refrigerant passage or the second refrigerant passage is mapped and stored; and a controller that controls supply of the refrigerant into the first and second evaporators on the basis of the information mapped in the memory, wherein the controller determines whether control time is changed on the basis of the information detected by the at least one temperature sensor.

4. The refrigerator according to claim 3, wherein the information with respect to the control time comprises:

information with respect to a first set-up time, at which an amount of refrigerant supplied into the first evaporator increases to prevent the refrigerant from being concentrated into the second evaporator; and information with respect to a second set-up time, at which an amount of the refrigerant supplied into the second evaporator increases to prevent the refrigerant from being concentrated into the first evaporator.

5. The refrigerator according to claim 4, wherein the controller increases the second set-up time when refrigerant concentration into the first evaporator is determined, and decreases the second set-up time when refrigerant concentration into the second evaporator is determined according to the information detected by the at least one temperature sensor.

6. The refrigerator according to claim 3, further comprising a first flow rate adjuster disposed in the first refrigerant passage; and a second flow rate adjuster disposed in the second refrigerant passage, wherein the information with respect to the control time comprises time information with respect to operation states of the flow adjuster and the first and second flow rare adjusters.

7. The refrigerator according to claim 6, wherein an opening degree of the first flow rate adjuster is greater than an opening degree of the second flow rate adjuster for the first set-up time to increase an amount of the refrigerant supplied into the first evaporator, and wherein the opening degree of the second flow rate adjuster is greater than the opening degree of the first flow rate adjuster for the second set-up time to increase an amount of the refrigerant supplied into the second evaporator.

8. The refrigerator according to claim 1, further comprising a main body including a refrigerator compartment and a freezer compartment, wherein the first evaporator is a refrigerator compartment evaporator to cool the refrigerator compartment, and wherein the second evaporator is a freezer compartment evaporator to cool the freezer compartment.

9. The refrigerator according to claim 8, wherein the main body comprises an outer case, an inner case, and a rear panel that covers the inner case, and wherein the gas/liquid separator is disposed in a heat-exchange chamber defined between the inner case and the rear panel.

10. The refrigerator according to claim 9, wherein the flow adjuster is disposed in the heat-exchange chamber.

11. The refrigerator according to claim 1, wherein the gas/liquid separator comprises:

a gas/liquid separation body comprising an inflow coupling device coupled to an inflow tube of the refrigerant; and a separation device disposed within the gas/liquid separation body to separate the refrigerant into the liquid refrigerant and the gaseous refrigerant.

12. The refrigerator according to claim 11, wherein the separation device comprises:

a separation body disposed to face the inflow coupling device; and at least one groove defined in a surface of the separation body.

13. The refrigerator according to claim 12, wherein the at least one groove extends downward to guide downward discharge of the liquid refrigerant.

14. A refrigerator, comprising:

first and second compressors that compress a refrigerant;

a condenser that condenses the refrigerant compressed in the first and second compressors;

a first capillary that decompresses the refrigerant condensed in the condenser;

a gas/liquid separator that receives the refrigerant decompressed in the first capillary;

a liquid discharge that extends from a lower portion of the gas/liquid separator;

a gaseous refrigerant discharge that extends from an upper portion of the gas/liquid separator;

a flow adjuster connected to the liquid discharge;

first and second refrigerant passages branched from the liquid discharge;

a refrigerator compartment evaporator disposed in the first refrigerant passage; and a freezer compartment evaporator disposed in the second refrigerant passage, wherein the gaseous refrigerant discharge comprises a bypass passage connected to an outlet-side of the refrigerator compartment evaporator.

15. The refrigerator according to claim 14, further comprising a second capillary disposed in the second refrigerant passage to decompress the refrigerant.

16. The refrigerator according to claim 14, further comprising:

a first flow rate adjuster disposed in the first refrigerant passage;

a second flow rate adjuster disposed in the second refrigerant passage; and a controller that controls at least one of operations of the flow adjuster and the first and second flow rate adjusters on the basis of a predetermined control time to change an amount of the refrigerant flowing into the first refrigerant passage or the second refrigerant passage.

17. The refrigerator according to claim 16, further comprising at least one temperature sensor that detects inlet and outlet temperatures of the refrigerator compartment evaporator or inlet and outlet temperatures of the freezer compartment evaporator, wherein the controller determines whether the predetermined control time is changed on the basis of the information detected by the at least one temperature sensor.

18. A refrigerator, comprising:

at least one compressor that compresses a refrigerant;

a condenser that condenses the refrigerant compressed in the at least one compressor;

a first expansion device that decompresses the refrigerant condensed in the condenser;

a gas/liquid separator that separates the refrigerant decompressed in the first expansion device into liquid refrigerant and gaseous refrigerant;

a flow adjuster connected to a liquid discharge of the gas/liquid separator;

a plurality of evaporators, into which the liquid refrigerant separated in the gas/liquid separator is selectively introduced by the flow adjuster, the plurality of evaporators including a first evaporator and a second evaporator;

a second expansion device disposed at an inlet-side of the second evaporator to decompress the refrigerant; and a main body including a refrigerator compartment and a freezer compartment, wherein the first evaporator is a refrigerator compartment evaporator to cool the refrigerator compartment, and the second evaporator is a freezer compartment evaporator to cool the freezer compartment, wherein the main body comprises an outer case, an inner case, and a rear panel that covers the inner case, and wherein the gas/liquid separator and the flow adjuster are disposed in a heat-exchange chamber defined between the inner case and the rear panel.

19. The refrigerator according to claim 18, further comprising:

a plurality of refrigerant passages that extends from the flow adjuster to the plurality of evaporators.

20. The refrigerator according to claim 19, further comprising:

a plurality of temperature sensors that detects temperatures of inlets and outlets of the plurality of evaporators;

a memory, in which information with respect to a control time according to a variation in amount of the refrigerant flowing into the plurality of refrigerant passages is mapped and stored; and a controller that controls supply of the refrigerant into the plurality of evaporators on the basis of the information mapped in the memory, wherein the controller determines whether the control time is changed on the basis of the information detected by the plurality of temperature sensors.

21. The refrigerator according to claim 20, further comprising:

a plurality of flow rate adjusters disposed in the plurality of refrigerant passages, respectively, wherein the information with respect to the control time comprises time information with respect to operation states of the flow adjuster and the plurality of flow rate adjusters.

22. A refrigerator, comprising:

at least one compressor that compresses a refrigerant;

a condenser that condenses the refrigerant compressed in the at least one compressor;

a first expansion device that decompresses the refrigerant condensed in the condenser;

a gas/liquid separator that separates the refrigerant decompressed in the first expansion device into liquid refrigerant and gaseous refrigerant;

first and second evaporators, into which the liquid refrigerant separated in the gas/liquid separator is introduced; and a second expansion device disposed at an inlet-side of the second evaporator to decompress the refrigerant, wherein the gas/liquid separator comprises:

a gas/liquid separation body comprising an inflow coupling device coupled to an inflow tube of the refrigerant; and a separation device disposed within the gas/liquid separation body to separate the refrigerant into the liquid refrigerant and the gaseous refrigerant, and wherein the separation device comprises:

a separation body disposed to face the inflow coupling device; and at least one groove defined in a surface of the separation body.

* * * * *